US006033284A

United States Patent [19]

Rodriguez Ferre

[11] Patent Number: 6,033,284

[45] Date of Patent: Mar. 7, 2000

[54] FORM OF ARTICULATED STRUCTURES FOR DOLLS OR PUPPET BODIES

[76] Inventor: Jose'Manuel Rodriguez Ferre, Poligono Industrial Derramador—Albacete s/n., 03440-IBI (Alicante), Spain

[21] Appl. No.: 08/220,462

[22] Filed: Mar. 31, 1994

Related U.S. Application Data

[63] Continuation of application No. 07/977,837, Nov. 17, 1992, abandoned.

[30] Foreign Application Priority Data

Aug. 5, 1992 [ES] Spain ..... 9201642

[51] Int. Cl.[7] ..... A63H 3/46

[52] U.S. Cl. ..... 446/383; 446/378

[58] Field of Search ..... 446/383, 378, 446/381, 384, 122, 120, 121

[56] References Cited

U.S. PATENT DOCUMENTS

| | | | |
|---|---|---|---|
| 719,310 | 1/1903 | Debes | 446/383 |
| 3,539,234 | 11/1970 | Rapata | 403/122 X |
| 4,268,991 | 5/1981 | Cotey et al. | 446/383 X |
| 4,954,118 | 9/1990 | Refabert | 446/383 X |

FOREIGN PATENT DOCUMENTS

| | | | |
|---|---|---|---|
| 1386510 | 12/1964 | France | 446/381 |
| 174835 | 8/1916 | Germany | 446/378 |
| 35744 | 6/1935 | Netherlands | 446/383 |

*Primary Examiner*—Robert A. Hafer
*Assistant Examiner*—Jeffrey D. Carlson
*Attorney, Agent, or Firm*—Birch, Stewart, Kolasch & Birch, LLP

[57] ABSTRACT

Improvements in the form of articulated structures for dolls or puppet bodies are disclosed. The improvements include a structure or skeleton-like framework in which the various elements and members which comprise it are connected with one another at their ends by link connections which in combination with the structure of the referenced ends constitute ball and socket articulations. The link connections are formed by two spheres 8*a* connected by a radial appendix 8*b*, over which is injected the integrating material making up the semispherical catches 9, constructed in the ends of the elements or members of the skeleton-like framework. The improvements are applicable in the manfuacture of articulated structures for dolls which permit stable and voluntary positioning of their members or connecting parts.

8 Claims, 3 Drawing Sheets

Fig. 3
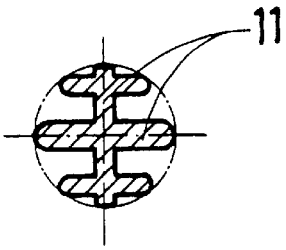
Fig. 4
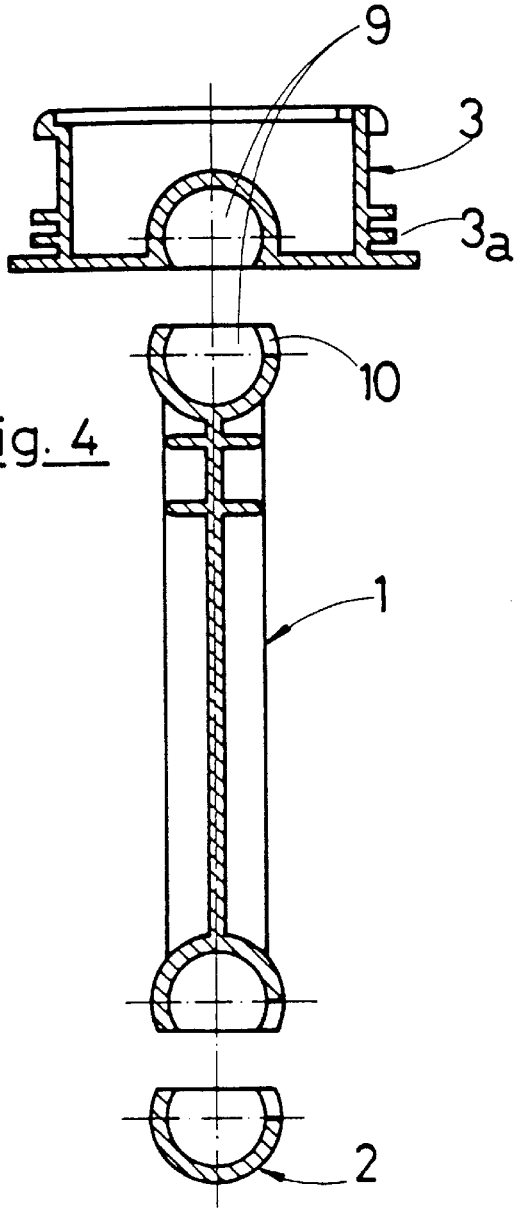
Fig. 5
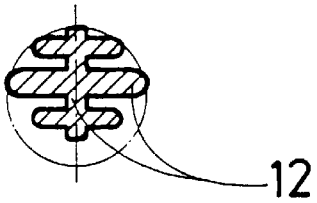
Fig. 6
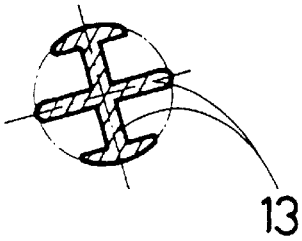
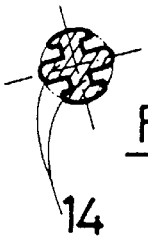
Fig. 7

FORM OF ARTICULATED STRUCTURES FOR DOLLS OR PUPPET BODIES

This application is a continuation of application Ser. No. 07/977,837 filed on Nov. 17, 1992, now abandoned.

BACKGROUND OF THE INVENTION

1. Field of the Invention

The present invention refers to improvements in the form of articulated structures for dolls or puppet bodies (henceforth, "doll", which can also be the body of a puppet), which, in the function for which they are intended, contribute various advantages which furnish a notable advancement over presently employed articulated structures to the organization and construction of the articulated structures.

2. Description of Related Art

It is already known in the doll market that articulation means are incorporated which allow for the movement of the doll members in order to adopt various postures which add greater realism to the doll and which at the same time extend the realms of possible games to be played beyond those with nonarticulated structures. Without exception, in the present state of technology there have been no steps forward and the articulation means continue to suffer from the defect of their principal drawback which is their low resistance, due to which the very weight of the member or any slight pressure thereon is capable of altering the established position of the member. Thus the postures of the doll are not maintained in a fixed position for a long time, which would be an attractive feature in the toy.

SUMMARY OF THE INVENTION

By virtue of its experience in the manufacture of toys, and more particularly the manufacture of dolls in its broader sense, such as those which adopt human, animal or any other type of form, the company petitions that it has conceived improvements which can be applied to the articulated structure of dolls of the type described above, by virtue of which arbitrary and multiple positions and postures can be consigned to dolls, and can be held stable for an indefinite length of time, while not constituting any obstacle to the manipulation of the doll by the child who is voluntarily making new changes of position.

The improvements according to the present invention offer the advantages which have been described above, in addition to others which are to be easily deduced from the representational embodiment of an articulated structure incorporating said improvements for dolls, which are described in greater detail hereinafter to facilitate comprehension of the features described above and drawings are provided to show the various details and, accompanying the present account, taken solely as a nonlimiting example of the scope of the present invention, one practical embodiment of the object of the same is represented.

BRIEF DESCRIPTION OF THE DRAWINGS

In the drawings:

FIGS. 3, 4, 5, 6 and 7 show respectively sections of the structure seen along 3—3; 4—4, 5—5, 6—6 and 7—7;

FIGS. 12 and 13 show respectively a basic part provided to obtain the link connection and the link connection obtained from said part by careful injection of a new application of material, all with the objective of attaining improved sphericity.

DETAILED DESCRIPTION OF PREFERRED EMBODIMENT(S)

Figure 1:
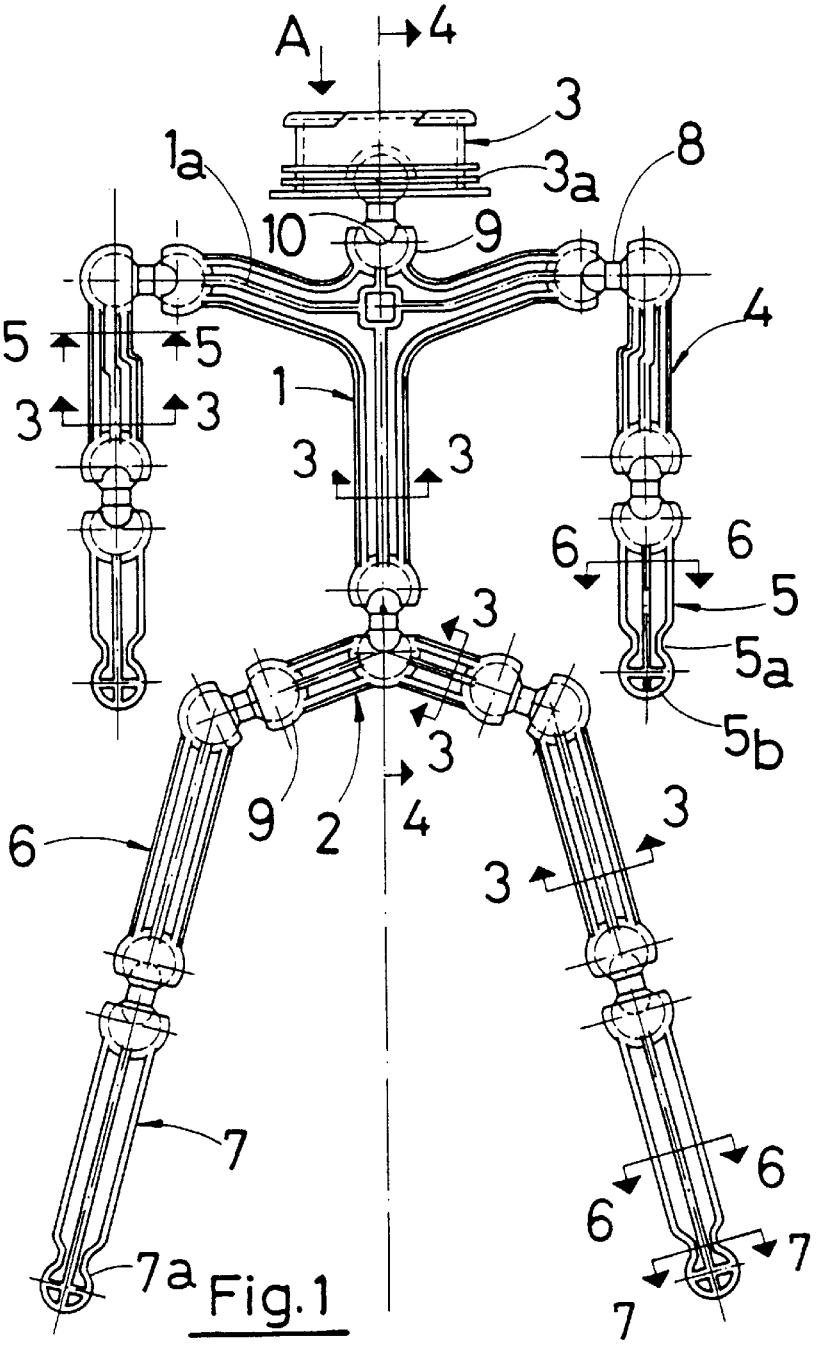
FIG. 1 corresponds to a plan view of the structure.
Figure 2:
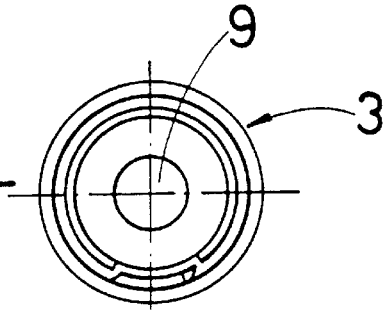
FIG. 2 is a detail of the top part of the structure, seen along "A"
Figure 8:
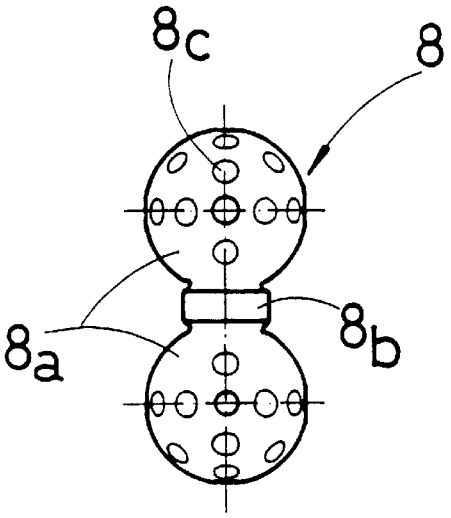
FIGS. 8 and 9 represent two link connections of the components of the structure.
Figure 9:
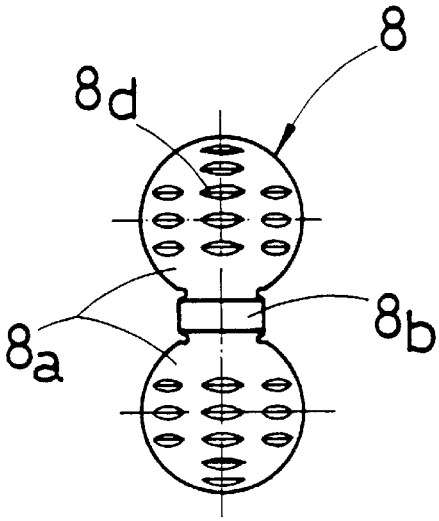
Figure 11:
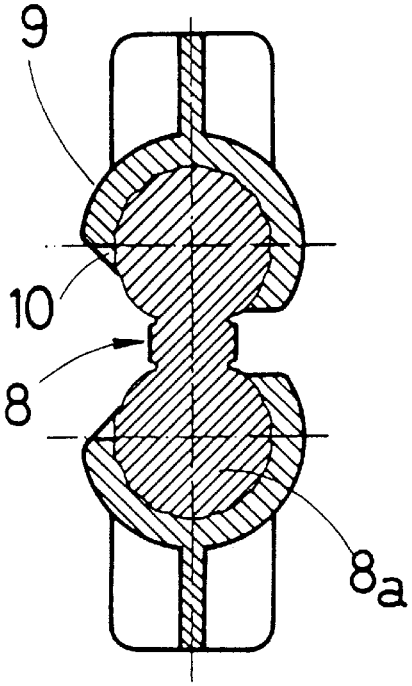
FIGS. 10 and 11 represent an articulation in greater detail, shown from the outside and sectioned through a diametral plane (through the center of the sphere) 11—11.
Figure 10:
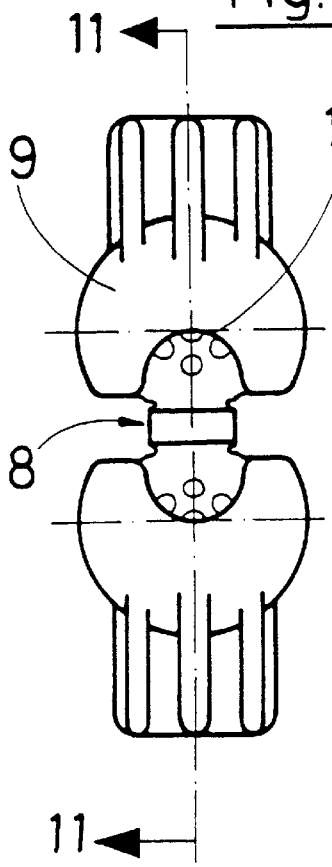

In the embodiment shown in the drawings, the articulated structure for dolls, furnished with the improvements of the invention and in accordance with one realization of the same, comprises a structure or skeleton-like framework constituted of the aforementioned structural elements, designated 1, 2 and 3, which correspond to the trunk, hips and neck or collar of a person; and members 4 and 5, and 6 and 7, making up the top and bottom extremities; and the link connections 8, which connect the aforementioned members with the principal elements 1, 2 and 3, and connect said principal elements among themselves.

Element 1 is constituted of a part manufactured of injected material which adopts a "T" configuration, shown in cross section in FIG. 3, shaped by ribs 11 which intersect orthogonally. The arms 1*a* of said part are essentially oblique, and the ends are finished by semispherical hollow forms, designated as 9, with recesses 10.

Element 2 is configured of a part comprising an obtuse angle of cross section identical to that of part 1, provided with semispheres 9 arranged in its ends and its apex.

Element 3, connected to element 1, is configured of a revolving cylindrical part, hollow and open at the top, with annular ribs 3*a*, and with a semisphere 9 at its bottom, with its opening to the exterior.

Member 4, forming both of the top extremities, presents a section 4—4, shown in FIG. 4, formed by ribs 12 which intersect orthogonally. Likewise, member 5, another component of said top extremities, presents a section 6—6, shown in FIG. 6, formed by intersecting ribs 13, one of them straight and the other in a double "t" shape, and shows a reduced cross section 5*a*, joining with an end 5*b*.

Member 4 presents semispheres 9 in its ends, with its opening at a 90 degree angle to the longitudinal axis of the member 4, while member 5 presents a semisphere of larger cross section at its end, with its opening aligned to a longitudinal axis of the member 4.

Member 5 presents a section 3—3, as shown in FIG. 3, and two semispherical ends of the same type as 9, with its opening arranged transverse and obliquely with respect to the longitudinal axis of said member.

Member 7 presents a section 6—6, as shown in FIG. 6, and a section 7—7, as shown in FIG. 7, formed by intersecting ribs 14 which join with an end 7*a*.

The link connections of the components described are configured by the parts 8 which comprise two spherical bodies 8*a* connected by a diametral appendix 8*b*. The surfaces of the spherical bodies can be smooth or else can include flat facets, curved concavely as in 8*c*, elongated fissures 8*d*, or some other type of protuberance or recess in order to offer frictional resistance with the inner surface of semispherical cavities 9, inside which they are to revolve, since this is the resistance which determines the fixation and immobility of the position adopted by the skeleton-like framework. The recesses 10 of these semispherical cavities coincide with the natural movement of the respective components, such as arms, legs, etc., in such a manner as to allow a greater inclination to swivel in this sense.

In some cases, a base part 15 is constructed beforehand to achieve improved sphericity in the link connections 8*a*, in the ends of which are constituted annular projections 15*a*. The material 16 is injected over said ends, and the material adopts a uniform spherical shape.

The structural components and members are joined with the link connections 8 during the actual manufacturing process, consisting of the injection of the material of the cited parts over the spheres 8*a*, in such a manner that they constitute an indivisible articulated whole.

The structural components and members, formed by longitudinal ribs which intersect orthogonally, present virtually circular cross sections, as can be appreciated in FIGS. 3 to 7.

I claim:

1. An articulated structure for dolls comprising:

a T-shaped upper torso member, an inverted V-shaped hip member, a cylindrical head member, and a plurality of elongated extremity members for upper and lower arms and upper and lower legs; and means for rotatably connecting adjacent ends of said members, said means for rotatably connecting including link connections having a shaft and substantially spherical bodies formed on opposing ends of said shaft, and a spherical hollow helmet-shaped socket portion formed in the adjacent ends of said members, said socket portion including a single opening on a distal end thereof and a single semicircular recess formed in the single opening for receiving a section of the shaft to facilitate a natural multidirectional movement of the members of said structure with a primary movement in a single direction, said substantially spherical bodies providing a frictional engagement with a respective socket portion, wherein said substantially spherical bodies each include a plurality of discretely spaced concave dimples formed in an outer surface thereof for controlling frictional resistance between said spherical bodies and corresponding socket portions.

2. The articulated structure according to claim 1, wherein the hip member and the cylindrical head member are connected to the "T"-shaped upper torso member by said means for connecting at mid-points of the same, situated in a top extension of the longitudinal section of the "T", corresponding to a connection existing in the base of the cylindrical head member, and in the opposite end of the longitudinal section of the aforementioned "T", in correspondence with another connection existing in the apex of the inverted V-shaped hip member.

3. The articulated structure according to claim 1, wherein said means for connecting are constituted by injection of a material which comprises separate structural elements over the spherical bodies, thereby forming an indivisible whole.

4. The articulated structure according to claim 1, wherein the distal ends of said spherical hollow helmet-shaped socket portion are spaced apart from each other by a length of the shaft of said link connections.

5. An articulated structure for dolls comprising:

a T-shaped upper torso member, an inverted V-shaped hip member, a cylindrical head member, and a plurality of elongated extremity members for upper and lower arms and upper and lower legs; and means for rotatably connecting adjacent ends of said members, said means for rotatably connecting including link connections having a shaft and substantially spherical bodies formed on opposing ends of said shaft, and a spherical hollow helmet-shaped socket portion formed in the adjacent ends of said members, said socket portion including a single opening on a distal side thereof and a single semicircular recess formed in the single opening for receiving a section of the shaft to facilitate a natural multidirectional movement of the member of said structure with a primary movement in a single direction, said substantially spherical bodies providing a frictional engagement with a respective socket portion, wherein said substantially spherical bodies each include a plurality of discretely spaced elongated fissures formed in an outer surface thereof and transverse to a longitudinal orientation of said shaft for controlling frictional resistance between said spherical bodies and corresponding socket portions.

6. The articulated structure according to claim 5, wherein the hip member and the cylindrical head member are connected to the "T"-shaped upper torso member by said means for connecting at mid-points of the same, situated in a top extension of the longitudinal section of the "T", corresponding to a connection existing in the base of the cylindrical head member, and in the opposite end of the longitudinal section of the aforementioned "T", in correspondence with another connection existing in the apex of the inverted V-shaped hip member.

7. The articulated structure according to claim 5, wherein said means for connecting are constituted by injection of a material which comprises separate structural elements over the spherical bodies, thereby forming an indivisible whole.

8. The articulated structure according to claim 5, wherein the distal ends of said spherical hollow helmet-shaped socket portion are spaced apart from each other by a length of the shaft of said link connections.

* * * * *